US010195494B2

(12) United States Patent
Matsuyama et al.

(10) Patent No.: US 10,195,494 B2
(45) **Date of Patent: *Feb. 5, 2019**

(54) GOLF BALL

(71) Applicant: SUMITOMO RUBBER INDUSTRIES, LTD., Kobe-shi, Hyogo (JP)

(72) Inventors: Yoshiko Matsuyama, Kobe (JP); Takahiro Sajima, Kobe (JP); Kohei Mimura, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/133,763

(22) Filed: Apr. 20, 2016

(65) Prior Publication Data

US 2016/0332033 A1 Nov. 17, 2016

(30) Foreign Application Priority Data

May 14, 2015 (JP) ..... 2015-099548

(51) Int. Cl.

| | |
|---|---|
| ***A63B 37/06*** | (2006.01) |
| ***A63B 45/00*** | (2006.01) |
| ***A63B 37/00*** | (2006.01) |
| ***A63B 45/02*** | (2006.01) |

(52) U.S. Cl.

CPC ..... *A63B 45/00* (2013.01); *A63B 37/0022* (2013.01); *A63B 37/0075* (2013.01); *A63B 45/02* (2013.01); *A63B 2209/00* (2013.01)

(58) Field of Classification Search

CPC ..... A63B 37/0022; A63B 37/14
USPC ..... 473/378
See application file for complete search history.

(56) References Cited

U.S. PATENT DOCUMENTS

| | | | | |
|---|---|---|---|---|
| 9,375,611 | B2 * | 6/2016 | Sajima | A63B 37/0022 |
| 2008/0182683 | A1 * | 7/2008 | Hirau | A63B 37/0003 473/377 |
| 2012/0329367 | A1 | 12/2012 | Fitchett et al. | |
| 2012/0329577 | A1 * | 12/2012 | Anderl | A63B 37/0022 473/378 |

FOREIGN PATENT DOCUMENTS

| | | | |
|---|---|---|---|
| JP | 10-234885 | A | 9/1998 |
| JP | 2002-369896 | A | 12/2002 |
| JP | 2008-183148 | A | 8/2008 |

OTHER PUBLICATIONS

Japanese Office Action for Japanese Application No. 2015-099548, dated Oct. 16, 2018, with English translation.

* cited by examiner

*Primary Examiner* — Raeann Gorden
(74) *Attorney, Agent, or Firm* — Birch, Stewart, Kolasch & Birch, LLP

(57) ABSTRACT

A golf ball according to the present invention includes a spherical core, a cover member including at least one layer that covers the core, and at least one coating layer that covers the cover member constituting an outermost layer. A plurality of dimples are formed in the cover member constituting the outermost layer. Roughness is formed on the surface of the coating layer. A maximum height Rz and an arithmetic average roughness Ra of the surface of the coating layer satisfy a relationship Rz≥Ra×6.0. The coating layer contains a lustrous material.

5 Claims, 1 Drawing Sheet

GOLF BALL

TECHNICAL FIELD

The present invention relates to a golf ball and a method for manufacturing the same.

BACKGROUND ART

A golf ball has a large number of dimples on its surface. The dimples disturb airflow around the golf ball during flight and cause turbulent separation. This phenomenon is referred to as "turbulence". Turbulence causes a separation point at which air separates from the golf ball to shift rearward, and thus drag is reduced. Moreover, turbulence promotes the shift between an upper separation point and a lower separation point due to backspin, and thus lift acting on the golf ball is enhanced. Accordingly, good dimples disturb airflow better, and thus significantly extend the flight distance.

CITATION LIST

Patent Literature

Patent Literature 1: JP H10-234885A

SUMMARY OF INVENTION

When a golfer hits a golf ball with a middle iron, for example, a large amount of spin is given to the golf ball. As a result, the golf ball is likely to pop up, and the flight distance sometimes becomes short. Such a problem is not only associated with middle irons. Conventionally, in order to suppress the pop-up, attempts have been made to improve the dimple specifications when designing the dimples. However, this problem has not been solved yet, and the improvement of aerodynamic performance regardless of the design of dimples has been desired. Also, there is demand for good appearance, that is, an excellent appearance property, in a golf ball. The present invention was achieved in order to solve the foregoing problems, and it is an object thereof to provide a golf ball that can improve flight performance and has an excellent appearance property, and a method for manufacturing the same.

A golf ball according to the present invention includes a spherical core, a cover member including at least one layer that covers the core, and at least one coating layer that covers the cover member constituting an outermost layer, wherein a plurality of dimples are formed in the cover member constituting the outermost layer, roughness is formed on a surface of the coating layer, a maximum height Rz and an arithmetic average roughness Ra of the surface of the coating layer satisfy a relationship $Rz \geq Ra \times 6.0$, and the coating layer contains a lustrous material.

In the golf ball, it is possible to set the particle diameter of the lustrous material to be 1 μm or more and 125 μm or less.

In the golf ball, it is possible to set the particle size distribution width of the lustrous material to be 115 μm or less.

The golf ball includes two or more layers of the coating layer, and the coating layers can respectively contain lustrous materials that differ from each other in particle diameter.

In the golf ball, it is possible to set the arithmetic average roughness Ra to be 0.5 μm or more.

In the golf ball, it is possible to set the maximum height Rz to be 4.0 μm or more.

A method for manufacturing a golf ball according to the present invention includes the steps of forming a spherical core, covering the core with a cover member including at least one layer and forming a plurality of dimples in the cover member constituting an outermost layer, covering the cover member constituting the outermost layer with a coating layer containing a lustrous material, and forming roughness on the coating layer, wherein a maximum height Rz and an arithmetic average roughness Ra of a surface of the coating layer satisfy a relationship $Rz \geq Ra \times 6.0$.

In the method, roughness can be formed by spraying minute particles which has an average particle diameter of 50 to 500 μm.

In the method, it is possible to set the particle diameter of the lustrous material to be 1 μm or more and 125 μm or less.

In the method, it is possible to set the particle size distribution width of the lustrous material to be 115 μm or less.

In the method, the golf ball includes two or more layers of the coating layer, and the coating layers can respectively contain lustrous materials that differ from each other in particle diameter.

In the method, it is possible to set the arithmetic average roughness Ra to be 0.5 μm or more.

In the method, it is possible to set the maximum height Rz to be 4.0 μm or more.

With the golf ball according to the present invention, it is possible to improve flight performance. In addition, it is possible to improve an appearance property.

DESCRIPTION OF EMBODIMENTS

1. Golf Ball

Figure 1:
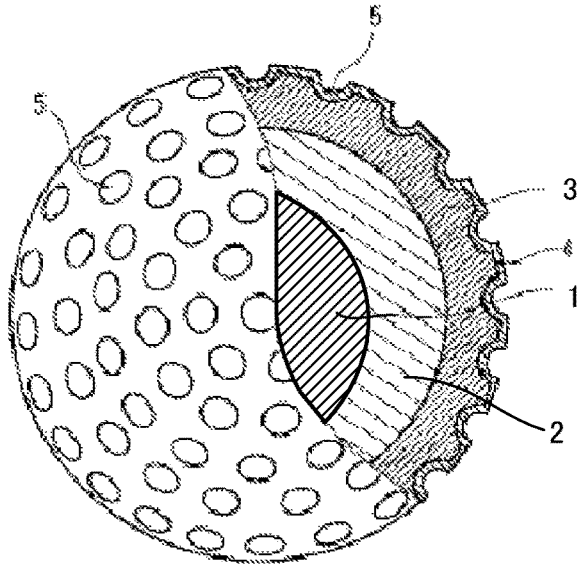
FIG. 1 is a partially cutaway cross-sectional view illustrating an embodiment of a golf ball of the present invention.

Hereinafter, an embodiment of a golf ball according to the present invention will be described with reference to the drawings. FIG. 1 is a partially cutaway cross-sectional view of a golf ball according to this embodiment.

As shown in FIG. 1, the golf ball includes a spherical core 1, an intermediate layer 2 that covers the core 1, a cover 3 that covers the intermediate layer 2, and a coating layer 4 that covers the surface of the cover 3.

The diameter of the golf ball is preferably 40 to 45 mm, and more preferably 42.67 mm or more from the viewpoint of meeting the standards of the United States Golf Association (USGA). From the viewpoint of suppressing air resistance, the diameter is preferably 44 mm or less, and more preferably 42.80 mm or less. Moreover, the mass of the golf ball is preferably 40 g or more and 50 g or less. In particular, from the viewpoint that a large inertia can be provided, the mass is preferably 44 g or more and more preferably 45.00 g or more. From the viewpoint of meeting the standards of the USGA, the mass is preferably 45.93 g or less.

1-1. Core

Next, members included in the golf ball will be described. The core 1 is formed by crosslinking a rubber composition. Examples of the base rubber for the rubber composition include polybutadiene, polyisoprene, styrene-butadiene copolymer, ethylene-propylene-diene copolymer, and natural rubber. Two or more types of rubber may be used in combination. Moreover, from the viewpoint of restitution performance, polybutadiene is preferable, and high-cis polybutadiene is particularly preferable.

The rubber composition of the core 1 includes a co-crosslinking agent. From the viewpoint of restitution performance, preferable co-crosslinking agents are zinc acrylate, magnesium acrylate, zinc methacrylate, and magnesium methacrylate. It is preferable that the rubber composition includes organic peroxide together with the co-crosslinking agent. Examples of the preferable organic peroxide include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 1 may include additives such as a filler, sulfur, a vulcanization accelerator, a sulfur compound, an antioxidant, a coloring agent, a plasticizer, a dispersant, a carboxylic acid, and a carboxylate. Furthermore, the rubber composition may also include synthetic resin powder or crosslinked rubber powder.

The diameter of the core 1 is preferably 30.0 mm or more, and particularly preferably 38.0 mm or more. On the other hand, the diameter of the core 1 is preferably 42.0 mm or less, and particularly preferably 41.5 mm or less. The core 1 may have two or more layers. There is no particular limitation on the shape of the core 1 as long as the core 1 has a spherical shape as a whole, and the core 1 may have ribs on its surface. Moreover, the core 1 may be hollow.

1-2. Intermediate Layer

Next, the intermediate layer 2 will be described. The intermediate layer 2 is made of a resin composition. An ionomer resin is a preferable base polymer for the resin composition. One example of a preferable ionomer resin is a bipolymer of α-olefin and α,β-unsaturated carboxylic acid that has 3 to 8 carbon atoms. Another example of a preferable ionomer resin is a terpolymer of α-olefin, α,β-unsaturated carboxylic acid that has 3 to 8 carbon atoms and α,β-unsaturated carboxylic acid ester that has 2 to 22 carbon atoms. In the bipolymer and the terpolymer, ethylene and propylene are preferable α-olefins, and acrylic acid and methacrylic acid are preferable α,β-unsaturated carboxylic acids. In the bipolymer and the terpolymer, some of the carboxyl groups are neutralized by metal ions. Examples of metal ions for neutralization include a sodium ion, potassium ion, lithium ion, zinc ion, calcium ion, magnesium ion, aluminum ion, and neodymium ion.

The resin composition of the intermediate layer 2 may include another polymer instead of the ionomer resin. Other examples of polymers include polystyrene, polyamide, polyester, polyolefin, and polyurethane. The resin composition may include two or more types of polymers.

The resin composition of the intermediate layer 2 may include a coloring agent such as titanium dioxide, a filler such as barium sulfate, a dispersant, an antioxidant, an ultraviolet absorber, a photostabilizer, a fluorescent agent, a fluorescent brightener, and the like. The resin composition may also include a powder of a metal with a high specific gravity, such as tungsten or molybdenum, in order to adjust the specific gravity.

The thickness of the intermediate layer 2 is preferably 0.2 mm or more, and particularly preferably 0.3 mm or more. On the other hand, the thickness of the intermediate layer 2 is preferably 2.5 mm or less, and particularly preferably 2.2 mm or less. The specific gravity of the intermediate layer 2 is preferably 0.90 or more, and particularly preferably 0.95 or more. The specific gravity of the intermediate layer 2 is preferably 1.10 or less, and particularly preferably 1.05 or less. The intermediate layer 2 may have two or more layers. For example, it is possible to arrange a reinforcing layer outside the intermediate layer 2.

1-3. Cover

The cover 3 is made of a resin composition. Polyurethane is a preferable base polymer for the resin composition. The resin composition may include thermoplastic polyurethane or thermosetting polyurethane. From the viewpoint of productivity, thermoplastic polyurethane is preferable. Thermoplastic polyurethane includes a polyurethane component as a hard segment and a polyester component or a polyether component as a soft segment.

Examples of a curing agent for the polyurethane component include alicyclic diisocyanate, aromatic diisocyanate, and aliphatic diisocyanate. Alicyclic diisocyanate is particularly preferable. Since alicyclic diisocyanate has no double bonds in its main chain, the yellowing of the cover 3 is suppressed. Examples of alicyclic diisocyanate include 4,4'-dicyclohexylmethane diisocyanate (H12MDI), 1,3-bis(isocyanatomethyl)cyclohexane (H6XDI), isophorone diisocyanate (IPDI), and trans-1,4-cyclohexane diisocyanate (CHDI). From the viewpoint of versatility and processability, H12MDI is preferable.

The resin composition of the cover 3 may include another polymer instead of polyurethane. Examples of other polymers include an ionomer resin, polystyrene, polyamide, polyester, and polyolefin. The resin composition may include two or more types of polymers.

The resin composition of the cover 3 may include a coloring agent such as titanium dioxide, a filler such as barium sulfate, a dispersant, an antioxidant, an ultraviolet absorber, a photostabilizer, a fluorescent agent, a fluorescent brightener, and the like.

The thickness of the cover 3 is preferably 0.2 mm or more, and more preferably 0.3 mm or more. The thickness of the cover 3 is preferably 2.5 mm or less, and particularly preferably 2.2 mm or less. The specific gravity of the cover 3 is preferably 0.90 or more, and particularly preferably 0.95 or more. The specific gravity of the cover 3 is preferably 1.10 or less, and particularly preferably 1.05 or less. It should be noted that the cover 3 may have two or more layers.

Figure 2:
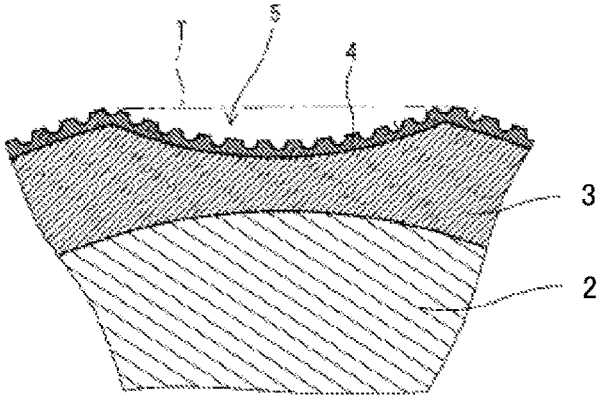
FIG. 2 is a partially enlarged cross-sectional view of FIG. 1.

Dimples 5 are formed in the surface of the cover 3. In FIG. 2, a virtual line T indicates a common tangent of two ends of the dimple 5. The volume of a portion enclosed by the virtual line T and the surface of the dimple 5 is the volume of the dimple 5. The total volume of the dimples 5 is preferably 270 $mm^3$ or more and 370 $mm^3$ or less. If the total volume is less than the above-mentioned range, the trajectory of the golf ball sometimes rises. From this viewpoint, the total volume is more preferably 290 $mm^3$ or more. If the total volume is more than the above-mentioned range, the trajectory of the golf ball will drop. From this viewpoint, the total volume is more preferably 350 $mm^3$ or less.

The ratio of the total area of the dimples 5 to the surface area of a virtual sphere is referred to as "occupation ratio". The occupation ratio is preferably 70% or more and 98% or less. If the occupation ratio is less than the above-mentioned range, there is a risk that lift of the golf ball during flight will be insufficient. From this viewpoint, the occupation ratio is more preferably 72% or more, and particularly preferably 75% or more. On the other hand, the occupation ratio is preferably 98% or less, and more preferably 95% or less. It should be noted that the area of the dimple 5 is the area of a region surrounded by an edge line (that is, the area of a planar shape) when the center of the golf ball is viewed from infinity.

The depth of each dimple 5 is preferably 0.1 mm or more and 0.6 mm or less. If the depth is less than the above-mentioned range, the trajectory of the golf ball sometimes rises. From this viewpoint, the depth is more preferably 0.12 mm or more, and particularly preferably 0.14 mm or more. On the other hand, if the depth is more than the above-mentioned range, the trajectory of the golf ball sometimes drops. From this viewpoint, the depth is more preferably 0.55 mm or less, and particularly preferably 0.50 mm or less. The ratio of the number of the dimples 5 whose depth is included in the above-mentioned range to the total number of the dimples 5 is preferably 50% or more, more preferably 65% or more, and particularly preferably 80% or more. The depth is the distance from the virtual line T to the deepest portion of the dimple 5.

The total number of the dimples 5 is preferably 200 or more and 500 or less. If the total number is less than the above-mentioned range, it is difficult to obtain the effect of the dimples. From this viewpoint, the total number is more preferably 230 or more, and particularly preferably 260 or more. On the other hand, if the total number is more than the above-mentioned range, it is difficult to obtain the effect of the dimples. From this viewpoint, the total number is more preferably 470 or less, and particularly preferably 440 or less.

It should be noted that a single type of or a plurality of types of the dimples 5 may be formed. Noncircular dimples (dimples whose planar shape is noncircular) may be formed instead of or together with the circular dimples 5.

1-4. Coating Layer

Next, the coating layer 4 will be described. The coating layer 4 is configured by covering the surface of the cover 3 with paint. The paint includes a lustrous material.

Specifically, a so-called clear paint layer that includes a resin component and a lustrous material and does not include other pigments can serve as the coating layer 4. A so-called enamel paint layer that includes a resin component, a lustrous material, and other pigments can also serve as the coating layer 4. Hereinafter, the resin component and the lustrous material will be described in detail.

First, the lustrous material will be described. One example of the lustrous material is a lustrous material obtained by covering a nucleus with one or more layers of a light reflecting substance. For example, such a lustrous material is obtained by covering the periphery of a nucleus made of natural mica, synthetic mica, pearl flake, glass flake, metal or a metal oxide with a light reflecting substance constituted by metal, a metal oxide or a metal nitride. At least one type of metal selected from the group consisting of aluminum, chromium, cobalt, gold, silver, nickel and iron can be used as the above-mentioned metal, for example. Examples of the metal oxides used for the nucleus and the light reflecting substance include titanium dioxide and iron oxide. Moreover, other than the above-mentioned lustrous material obtained by covering a nucleus with a light reflecting substance, bright metal powder can also be used as the lustrous material.

Specific examples of the lustrous material include a material obtained by covering the periphery of a nucleus made of synthetic mica or natural mica with a metal oxide constituted by titanium oxide or iron oxide ("Iriodin" available from Merck), a material obtained by covering the periphery of a nucleus made of glass flake with a metal oxide such as titanium dioxide or iron oxide or metal such as gold, silver or nickel ("Metashine" available from Nippon Sheet Glass Co., Ltd.), and a material obtained by covering the periphery of a nucleus made of aluminum or iron oxide with a metal oxide constituted by silicon dioxide or iron oxide ("Paliocrom" available from BASF).

The particle diameter of the lustrous material as described above is preferably 1 μm or more, and more preferably 5 μm or more. This is because if the particle diameter is 1 μm or less, the effect of lustrousness decreases. Moreover, the particle diameter is preferably 125 μm or less, more preferably 90 μm or less, and still more preferably 80 μm or less. This is because if the particle diameter is more than 125 μm, the appearance deteriorates due to spots or the like. It should be noted that the particle diameter can be measured with a laser diffraction method using Mastersizer available from Malvern Instruments Ltd., for example. The lustrous material having a particle diameter out of the range from 1 to 125 μm may also be included.

In addition, the particle size distribution width of the lustrous material having the above-described particle diameter is preferably 115 μm or less, more preferably 100 μm or less, and still more preferably 90 μm or less. This is because if the particle size distribution width is more than 115 μm, the lustrousness decreases. In particular, the narrower particle size distribution width is preferable because light can be uniformly reflected to increase the lustrousness. It should be noted that the "particle size distribution width" refers to a range (including 95.45% of the all data) from a value that is 2σ smaller than the particle size distribution to a value that is 2σ larger than the particle size distribution when the particle size distribution is assumed to be a normal distribution. Moreover, the particle diameter can be measured with the laser diffraction method using Mastersizer available from Malvern Instruments Ltd. as described above.

Next, the resin component constituting the coating layer 4 will be described. There is no particular limitation on the resin component, and an acrylic resin, an epoxy resin, a polyurethane resin, a polyester-based resin, a cellulose-based resin, and the like can be used. It is preferable to use a two-part curable polyurethane resin, which will be described later. This is because if the two-part curable polyurethane resin is used, a coating having an excellent durability can be obtained.

The two-part curable polyurethane resin is a polyurethane resin obtained by reacting a main agent and a curing agent, and one example is a polyurethane resin obtained by curing a main agent including a polyol component using a polyisocyanate compound or a derivative thereof.

It should be noted that the coating layer 4 may also include additives that can be generally contained in paint for golf gear, such as an ultraviolet absorber, an antioxidant, a photostabilizer, a fluorescent brightener, a blocking preventing agent, and a pigment, in addition to the above-described base resin and the like.

The thickness of the coating layer 4 is preferably 5.0 μm or more, more preferably 5.5 μm or more, and particularly preferably 6.0 μm or more. This is because if the thickness of the coating layer 4 is less than 5.0 μm, there is a risk that the coating layer 4 will come off of the cover 3 in a step of forming roughness, which will be described later. On the other hand, there is no particular limitation on the upper limit of the thickness of the coating layer 4, but if the thickness of the coating layer 4 is increased by increasing the amount of paint applied, for example, there is a high possibility that the thickness of the coating layer 4 of the entire ball will not be uniform. From this viewpoint, the thickness of the coating layer 4 is preferably 30 μm or less.

There is no particular limitation on the content of the lustrous material in the coating layer 4, but it is preferable that the content is preferably 1 part by mass or more, more preferably 3 parts by mass or more, and still more preferably 5 parts by mass or more with respect to 100 parts by mass of the resin component, and the content is preferably 20 parts by mass or less, more preferably 15 parts by mass or less, and still more preferably 13 parts by mass or less with respect to 100 parts by mass of the resin component. This is because if the content of the lustrous material is smaller than the lower limit, the lustrousness tends to be insufficient, and if the content of the lustrous material is larger than the upper limit, the durability of the coating tends to decrease.

It should be noted that the coating layer 4 can be made by forming a single layer or laminating a plurality of layers. If a plurality of coating layers 4 are formed, the coating layers 4 can be allowed to contain the same type of lustrous material or different lustrous materials. When different lustrous materials are used in the coating layers 4, it is possible to obtain both the concealing effect and the effect of lustrousness, and there is an advantage that the degree of freedom of color combinations increases.

Furthermore, roughness is formed on the surface of the coating layer 4. That is, as described later, after the smooth coating layer 4 is formed on the cover 3, roughness is formed on the surface of the coating layer 4. There are various methods for defining roughness. The inventors of the present invention used a maximum height Rz and an arithmetic average roughness Ra, and thus found that the desired aerodynamic effect could be obtained when the relationship between the Rz and the Ra satisfied the following expression.

$$Rz \geq Ra \times 6.0 \qquad \text{Exp. 1}$$

In particular, it was found that when the relationship between the maximum height Rz and the arithmetic average roughness Ra satisfied Expression 1 above, lift acting on the golf ball was suppressed, and as a result, the height of the trajectory was suppressed when hitting the golf ball, thus extending the flight distance.

In this embodiment, the arithmetic average roughness Ra of the coating layer 4 is preferably 0.5 μm or more, more preferably 0.6 μm or more, and particularly preferably 0.7 μm or more. This is because if the arithmetic average roughness Ra is less than 0.5 μm, a sufficient aerodynamic effect due to roughness cannot be obtained. On the other hand, there is no particular limitation on the upper limit of the arithmetic average roughness Ra, but if roughness is increased, there is a possibility that the coating layer 4 will fail to come into close contact with the cover 3 or the coating layer 4 will come off of the cover 3, and therefore, the arithmetic average roughness Ra is preferably 5 μm or less.

On the other hand, the maximum height Rz is preferably 4.0 μm or more, more preferably 4.5 μm or more, and particularly preferably 5.0 μm or more. This is because if the maximum height Rz is less than 4.0 μm, a sufficient aerodynamic effect due to roughness cannot be obtained. On the other hand, there is no particular limitation on the upper limit of the maximum height Rz, but if roughness is increased, there is a possibility that the coating layer 4 will fail to come into close contact with the cover 3 or the coating layer 4 will come off of the cover 3, and therefore, the maximum height Rz is preferably 20 μm or less. It should be noted that the maximum height Rz and the arithmetic average roughness Ra are measured in accordance with JIS B0601 (2001).

2. Method for Manufacturing Golf Ball

The golf ball is manufactured as follows. Known methods are used as appropriate as a method for manufacturing such a golf ball. First, the core 1 is molded, and the intermediate layer 2 and the cover 3 are molded around the core 1 in this order. The dimples 5 are formed simultaneously with the molding of the cover 3. That is, a cavity of a metal mold for molding the cover is provided with a large number of raised portions for molding the dimples. Next, paint is applied to the surface of the cover 3. The coating layer 4 can be obtained by drying this paint. There is no particular limitation on the painting method when using curable paint, and known methods can be used. Examples thereof include spray painting and electrostatic painting.

When spray painting using an air gun is performed, a mixture obtained by supplying a polyol component and a polyisocyanate component using respective pumps and by continuously mixing them using a line mixer disposed directly in front of the air gun may be applied by spraying, or polyol and polyisocyanate may be separately applied by spraying using an air spray system including a mixing ratio control mechanism. Coating may be achieved at one time by a spray application or may be repeated multiple times.

The curable paint, which has been applied to the golf ball body, can form a coating by being dried at a temperature of 30 to 70° C. for 1 to 24 hours, for example.

3. Method for Forming Roughness of Coating Layer

Next, a method for forming roughness of the coating layer 4 will be described. There are various methods for forming roughness of the coating layer 4, such as the following two methods.

3-1. Surface Treatment by Spraying Minute Particles

In this method, roughness is formed by spraying minute particles onto the surface of the coating layer 4. It is possible to spray minute particles with an air gun or the like onto the entire surface while rotating the ball, for example. It is desirable that the spraying pressure at this time is 1 to 10 bar. This is because a spraying pressure that is less than 1 bar makes it difficult to obtain the desired roughness, whereas a spraying pressure that is more than 10 bar poses a risk of damaging not only the coating layer 4 but also the cover 3.

Various types of minute particles can be used as the minute particles used in this method. Examples thereof include a natural ore, a synthetic resin, and ceramic-based particles. For example, SiC, $SiO_2$, $AL_2O_3$, MgO, and $Na_2O$, or a mixture thereof can be used as a natural ore, and a thermoplastic resin and thermosetting resin that contain a melamine-based resin as a main component, or a mixture thereof can be used as a synthetic resin. Moreover, one example of the ceramic-based particles is metal oxide such as zirconia. However, it is preferable to use minute particles having an average particle diameter of 50 μm or more in order to obtain the desired roughness. There is no particular limitation on the upper limit of the average particle diameter of the minute particles, but if the particle diameter is increased, there is a possibility that it will be difficult to spray the particles, and therefore, the average particle diameter is preferably 500 μm or less.

It should be noted that if the thickness of the coating layer 4 is too small when roughness is formed by this method, there is a risk that the coating layer 4 will come off during the spraying of minute particles. From this viewpoint, the thickness of the coating layer 4 is as described above.

3-2. Pressing Treatment

In this method, the desired roughness is formed by performing pressing treatment using a metal mold in which roughness has been formed on the inner wall surface of the cavity after the coating layer 4 is formed. Accordingly, the desired roughness is formed on the inner wall surface of the cavity in advance. There is no particular limitation on the metal mold used in this method as long as roughness is formed, and, for example, the same metal mold used to mold the dimples can be used. Roughness can be formed in advance on the inner wall surface of the cavity by spraying minute particles as described above.

It should be noted that if the thickness of the coating layer 4 is too small when roughness is formed by this method, it is difficult to form the desired roughness. From this viewpoint, the thickness of the coating layer 4 is as described above.

As described above, it was found that, with this embodiment, when the relationship between the maximum height Rz and the arithmetic average roughness Ra satisfied Expression 1 above, lift acting on the golf ball was suppressed, and as a result, the height of the trajectory was suppressed when hitting the golf ball, thus extending the flight distance. However, if roughness is formed on the surface of a golf ball, the lustrousness of the coating layer 4 decreases, and the appearance of the golf ball is like that of an old ball. Therefore, in this embodiment, the coating layer 4 contains the lustrous material. This makes it possible to improve an appearance property of a golf ball even if roughness is formed on the surface of the golf ball, and to give the golf ball a high-end appearance.

Although an embodiment of the present invention has been described above, the present invention is not limited to the above embodiment, and various modifications can be carried out without departing from the gist of the invention. For example, as described above, there is no particular limitation on the number of layers of the core 1, the intermediate layer 2, and the cover 3, and it is sufficient to cover at least the surface of the member at the outermost layer with the coating layer. It should be noted that the above-described embodiment is constituted by three layers, namely the core 1, the intermediate layer 2, and the cover 3, and the intermediate layer and the cover correspond to a cover member of the present invention. Moreover, a two-piece structure including the core and the cover can also be achieved.

Working Examples

Hereinafter, working examples of the present invention will be described. However, the present invention is not limited to the following working examples.

Here, eleven types of golf balls in total including Working Examples 1 to 8 and Comparative Examples 1 to 3 were examined. These golf balls have the same basic specifications, but differ from each other in surface roughness and a lustrous material contained in the coating layer. Accordingly, first, the common specifications will be described.

Common Specifications

A rubber composition was obtained by kneading 100 parts by mass of high-cis polybutadiene (product name "BR-730" available from JSR Corporation), 35 parts by mass of zinc acrylate, 5 parts by mass of zinc oxide, 5 parts by mass of barium sulfate, 0.5 parts by mass of diphenyl disulfide, 0.9 parts by mass of dicumyl peroxide, and 2.0 parts by mass of zinc octanoate. This rubber composition was placed into a metal mold constituted by an upper mold and a lower mold, both of which have a semispherical cavity, and was heated at 170° C. for 18 minutes, and thus a core having a diameter of 39.7 mm was obtained.

A resin composition was obtained by kneading 50 parts by mass of an ionomer resin (product name "Surlyn 8945" available from Du Pont), 50 parts by mass of another ionomer resin (product name "Himilan AM7329" available from Du Pont-Mitsui Polychemicals), 4 parts by mass of titanium dioxide, and 0.04 parts by mass of ultramarine blue using a twin-screw kneading extruder. An intermediate layer was formed by covering the core with this resin composition by an injection molding method. The thickness of this intermediate layer was 1.0 mm.

A paint composition (product name "Polin 750LE" available from Shinto Paint Co., Ltd.) containing a two-part curable epoxy resin as a base polymer was prepared. The main agent liquid for the paint composition is constituted by 30 parts by mass of a bisphenol A-type solid epoxy resin and 70 parts by mass of a solvent. The curing agent liquid for the paint composition is constituted by 40 parts by mass of modified polyamide amine, 55 parts by mass of a solvent, and 5 parts by mass of titanium oxide. The mass ratio of the main agent liquid to the curing agent liquid is 1/1. The paint composition was applied to the surface of the intermediate layer using a spray gun, and was held in an atmosphere of 23° C. for 6 hours, and thus a reinforcing layer was obtained. The thickness of this reinforcing layer was 10 μm.

A resin composition was obtained by kneading 100 parts by mass of a thermoplastic polyurethane elastomer (product name "Elastollan XNY85A" available from BASF Japan Ltd.) and 4 parts by mass of titanium dioxide using a twin-screw extruder. Half shells were made of this resin composition by a compression molding method. A sphere constituted by the core, the intermediate layer, and the reinforcing layer was covered with the two half shells. The half shells and the sphere were placed into a final metal mold constituted by an upper mold and a lower mold, both of which have a semispherical cavity and have a large number of pimples on the surface of the cavity, and then a cover was formed by a compression molding method. The thickness of the cover was 0.5 mm. The cover was provided with dimples each having an inverted pimple shape. A coating layer was formed by applying a clear paint containing two-part curable polyurethane as a base material onto the surface of the cover.

Specifically, the golf ball body was mounted on a rotator, and then the clear paint was applied while rotating the rotator at 300 rpm and vertically moving an air gun that was separated from the golf ball body by a spraying distance (7 cm). Each interval between the repeated applications was set to 1.0 second. The paint was applied using an air gun under spraying conditions in which the spraying air pressure was 0.15 MPa, the force feeding tank air pressure was 0.10 MPa, the single application time was 1 second, the ambient temperature was 20 to 27° C., and the ambient humidity was 65% or less. It should be noted that the coating layers of Working Examples 1 to 8 contained the lustrous material as described later.

The thickness of the coating layer of each of the working examples and comparative examples was 18 μm. The paint was applied twice. The thickness of the coating layer will be described later. As a result, golf balls having a diameter of about 42.7 mm and a mass of about 45.6 g were obtained. The compressive deformation amount measured by a YAMADA compression tester when setting the load to 98 to 1274 N was about 2.45 mm. Table 1 shows the specifications of the dimples of the golf ball. That is, each golf ball was provided with eight types of dimples.

TABLE 1

| Type | Number | Diameter Dm (mm) | Depth Dp (mm) | Curvature CR (mm) | Spherical surface areas ($mm^2$) | Volume ($mm^3$) |
|---|---|---|---|---|---|---|
| A | 16 | 4.600 | 0.259 | 19.66 | 16.67 | 2.157 |
| B | 30 | 4.500 | 0.254 | 18.82 | 15.95 | 2.021 |
| C | 30 | 4.400 | 0.249 | 17.99 | 15.25 | 1.892 |
| D | 150 | 4.300 | 0.244 | 17.19 | 14.56 | 1.770 |
| E | 30 | 4.200 | 0.239 | 16.40 | 13.89 | 1.654 |
| F | 66 | 4.100 | 0.234 | 15.63 | 13.23 | 1.544 |
| G | 10 | 3.800 | 0.220 | 13.44 | 11.36 | 1.247 |
| H | 12 | 3.400 | 0.203 | 10.77 | 9.09 | 0.922 |

Working Examples

The coating layers of Working Examples 1 to 8 contained the lustrous material. As shown in Table 2, there were five types of lustrous materials A to E, and they were used in Working Examples 1 to 8. Moreover, Table 3 shows the parts of the lustrous material mixed with respect to 100 parts by mass of the resin component in the coating layer.

TABLE 2

| | Particle size distribution | Particle size distribution width | Material name | Maker | Nucleus |
|---|---|---|---|---|---|
| A | 10 μm or less | 10 μm | TWINCLE PEARL SXA (white pearl) | Nihon Koken Kogyo Co., Ltd. | Synthetic mica |
| B | 5 to 30 μm | 25 μm | TWINCLE PEARL BXB (blue) | Nihon Koken Kogyo Co., Ltd. | Synthetic mica |
| C | 10 to 60 μm | 50 μm | TWINCLE PEARL BXD (blue) | Nihon Koken Kogyo Co., Ltd. | Synthetic mica |
| D | 20 to 80 μm | 60 μm | TWINCLE PEARL VXD (violet) | Nihon Koken Kogyo Co., Ltd. | Synthetic mica |
| E | 10 to 125 μm | 115 μm | Iriodin 299 (green) | Merck | Natural mica |

TABLE 3

| | Work. Ex. 1 | Work. Ex. 2 | Work. Ex. 3 | Work. Ex. 4 | Work. Ex. 5 | Work. Ex. 6 | Work. Ex. 7 | Work. Ex. 8 | Comp. Ex. 1 | Comp. Ex. 2 | Comp. Ex. 3 |
|---|---|---|---|---|---|---|---|---|---|---|---|
| Type of minute particle | Synthetic resin | Natural ore | Ceramic-based particle | Natural ore | Natural ore | Natural ore | Natural ore | Synthetic resin | | Natural ore | Ceramic-based particle |
| Diameter of minute particle (μm) | 150-250 | 75-150 | 75-150 | 75-150 | 75-150 | 75-150 | 250-500 | 150-250 | | 75-150 | 75-150 |
| Spraying pressure (bar) | 5.5 | 1.5 | 1.5 | 3.5 | 5.5 | 7.5 | 5.5 | 5.5 | | 1.5 | 1.5 |
| Ra (μm) | 0.40 | 0.57 | 0.75 | 0.77 | 0.93 | 1.04 | 1.51 | 0.40 | 0.36 | 0.57 | 0.75 |
| Rz (μm) | 3.85 | 4.92 | 5.40 | 6.52 | 6.90 | 7.70 | 10.10 | 3.85 | 1.12 | 4.92 | 5.40 |
| Thickness of coating layer (μm) | 18 | 18 | 18 | 18 | 18 | 18 | 18 | 18 | 18 | 18 | 18 |
| Type of lustrous material | C | C | C | A | B | D | C | E | | | |
| Mixed parts | 10 | 15 | 20 | 15 | 15 | 15 | 15 | 10 | | | |

In Working Examples 1 to 8, roughness was formed on the surface of the coating layer by the following method. That is, after the coating layer was formed, minute particles were sprayed thereon using an air gun having a nozzle diameter of 8 mm. At this time, 20 balls of each working example were placed into a predetermined treatment device, and minute particles were sprayed thereon with a predetermined pressure for about 1 minute while rotating the device. The pressure at this time and minute particles used are as shown in Table 3.

Comparative Examples

The coating layers of Comparative Examples 1 to 3 contained no lustrous material. In Comparative Example 1, after the coating layer was formed, surface treatment was not performed on its surface. In Comparative Examples 2 and 3, as in the above-described Working Examples 1 to 8, after the coating layer was formed, roughness was formed by spraying minute particles. The pressure at this time and minute particles used are as shown in Table 3 above.

The maximum height Rz, the arithmetic average roughness Ra, and the like in the working examples and comparative examples, which were formed as described above, are as shown in Table 3 above.

The maximum height Rz and the arithmetic average roughness Ra were measured using a surface roughness measuring instrument (Surfcom 130A available from Tokyo Seimitsu Co., Ltd.). Six balls of each of the working examples and comparative examples were prepared, roughness was measured at six points in a dimple of each ball, and the average values were used as the Rz and the Ra. Moreover, the relationship between the measured Ra and Rz was satisfied in the working examples and comparative examples other than Comparative Example 1.

Evaluation Test

A flight distance test and a sensory test for an appearance property were performed on the working examples and comparative examples formed as described above.

1. Flight Distance Test

An iron club (product name "SRIXON Z525" available from Dunlop Sports Co., Ltd.; a five iron, shaft hardness: S, loft angle: 24°) was attached to a swing machine available from Golf Laboratories Inc. Then, 20 balls of each type of the golf balls were hit, the distance (carry) to the point where the ball fell was measured, and the average was calculated. The balls were hit under conditions in which the head speed was 41 m/sec, the launch angle was about 14°, and the backspin speed was about 4700 rpm. The test was performed in a state where substantially no wind blew.

2. Sensory Test for Appearance Property

Ten golfers evaluated whether or not the golf balls of the working examples and comparative examples had a high-end appearance. The golf balls were evaluated as follows based on the number of golfers whose evaluation was that the golf ball had a high-end appearance.

Evaluation A: Seven golfers or more

Evaluation B: Five golfers or more

Evaluation C: Four golfers or more

Evaluation D: Three golfers or more

3. Evaluation

The results are as described in Table 4. In the flight distance test, the trajectories of Working Examples 1 to 8 and Comparative Examples 2 and 3 in which surface roughness was formed so as to satisfy Expression 1 were lower than that of Comparative Example 1. That is, it is thought that lift was reduced due to setting roughness of the coating films of the working examples so as to satisfy Expression 1. As a result, the flight distances of Working Examples 1 to 8 and Comparative Examples 2 and 3 were extended compared with that of Comparative Example 1. On the other hand, it was found that in the sensory test for an appearance property, Working Examples 1 to 8 containing the lustrous material received higher evaluation than Comparative Examples 1 to 3 containing no lustrous material did.

TABLE 4

| | Work. Ex. 1 | Work. Ex. 2 | Work. Ex. 3 | Work. Ex. 4 | Work. Ex. 5 | Work. Ex. 6 | Work. Ex. 7 | Work. Ex. 8 | Comp. Ex. 1 | Comp. Ex. 2 | Comp. Ex. 3 |
|---|---|---|---|---|---|---|---|---|---|---|---|
| Carry (m) | 175.7 | 176.2 | 175.9 | 176.4 | 176.6 | 176.9 | 176.7 | 175.7 | 175.0 | 176.2 | 175.9 |
| Trajectory height (m) | 30.5 | 30.5 | 30.3 | 30.4 | 30.3 | 30.1 | 29.8 | 30.5 | 31.0 | 30.5 | 30.3 |
| Appearance | A | A | A | A | A | A | A | B | C | D | D |

REFERENCE SIGNS LIST

1 Core
3 Cover
4 Coating layer
5 Dimple
Rz Maximum height
Ra Arithmetic average roughness

The invention claimed is:

1. A golf ball comprising:

a spherical core;

a cover member including at least one layer that covers the core; and two or more coating layers that cover the cover member constituting an outermost layer, wherein a plurality of dimples are formed in the cover member outermost layer, the coating layers surface has a roughness formed thereon, a maximum height Rz and an arithmetic average roughness Ra of the surface of the coating layers satisfy a relationship $Rz \geq Ra \times 6.0$, and each of the coating layers contains the same type of lustrous material or a different type of lustrous material.

2. The golf ball according to claim 1, wherein the lustrous material has a particle diameter of 1 μm or more and 125 μm or less.

3. The golf ball according to claim 1, wherein the lustrous material has a particle size distribution width of 115 μm or less.

4. The golf ball according to claim 1, wherein the arithmetic average roughness Ra is 0.5 μm or more.

5. The golf ball according to claim 1, wherein the maximum height Rz is 4.0 μm or more.

* * * * *